US006642846B1

(12) United States Patent
Krubiner et al.

(10) Patent No.: US 6,642,846 B1
(45) Date of Patent: Nov. 4, 2003

(54) INFRARED INTRUSION DETECTOR AND METHOD

(75) Inventors: Dani Krubiner, Tel-Aviv (IL); Bar Strauss, Matan (IL); Eyal Yagoda, Tel-Aviv (IL)

(73) Assignee: Electronics Line (E.L.) Ltd., Petach Tikva (IL)

( * ) Notice: Subject to any disclaimer, the term of this patent is extended or adjusted under 35 U.S.C. 154(b) by 0 days.

(21) Appl. No.: 09/455,002

(22) Filed: Dec. 6, 1999

(51) Int. Cl.[7] ..... G08B 13/08

(52) U.S. Cl. ..... 340/545.3; 340/541; 340/567; 340/511; 340/522; 340/578; 250/342; 250/347; 250/349

(58) Field of Search ..... 340/545.3, 541, 340/567, 511, 522, 578; 250/342, 349, 347

(56) References Cited

U.S. PATENT DOCUMENTS 4,447,726 A * 5/1984 Mudge et al. ..... 250/342
4,451,733 A * 5/1984 Avery et al. ..... 250/342
4,523,095 A * 6/1985 Keller-Steinbach ..... 250/349
4,604,524 A * 8/1986 Kitlicki et al. ..... 250/342
4,709,152 A 11/1987 Muller et al.
4,752,769 A * 6/1988 Knaup et al. ..... 340/567
5,066,855 A 11/1991 Lee
5,283,551 A * 2/1994 Guscott ..... 340/567
5,317,620 A * 5/1994 Smitth ..... 379/40
5,453,733 A * 9/1995 Peterson et al. ..... 340/567
5,586,620 A * 12/1996 Dammeyer et al. ..... 187/227
5,717,203 A * 2/1998 Yung ..... 250/221
6,288,395 B1 * 9/2001 Kuhnly et al. ..... 250/339.04
6,384,414 B1 * 5/2002 Fisher et al. ..... 250/339.14

* cited by examiner

*Primary Examiner*—Daniel J. Wu
*Assistant Examiner*—Tai T. Nguyen
(74) *Attorney, Agent, or Firm*—Eitan, Pearl, Latzer & Cohen Zedek, LLP.

(57) ABSTRACT

An intrusion detector for detecting an intrusion into a protected space overlying a predetermined surface is provided. In one embodiment, the intrusion detector includes a housing to be mounted over the surface and including an infrared radiation sensor for sensing moving infrared radiation sources, and a transparent window thereover, a plurality of lens elements formed in the transparent window each oriented to receive infrared radiation from a moving infrared radiation source within a predetermined viewing zone of the protected space and to transmit infrared radiation from said source to the sensor; an alarm; and a control system for receiving the electrical output of the sensor and for outputting an alarm signal to the alarm when an infrared radiation source is detected simultaneously within at least two of the predetermined viewing zones.

29 Claims, 9 Drawing Sheets

INFRARED INTRUSION DETECTOR AND METHOD

CROSS-REFERENCE TO RELATED APPLICATIONS

The present application claims priority from Israeli Patent Application No. 127407 entitled "INFRARED INTRUSION DETECTOR AND METHOD", filed Dec. 6, 1998.

FIELD AND BACKGROUND OF THE INVENTION

The present relates to intrusion detectors, and particularly to infrared intrusion detectors and methods for detecting an intrusion in a protected space.

One known form of intrusion detector includes an infrared radiation sensor and a transparent window formed with a plurality of lens elements each oriented to receive infrared radiation from an infrared radiation source within a predetermined viewing zone of the protected space. The sensor includes a pair (sometimes a quad) of sensor segments mounted close to each other and electrically connected in a bucking relationship for each viewing zone defined by a lens element, such that a radiation source produces equal but opposite, and therefore zero, electrical outputs from the pair (or quad) of radiation sensing elements canceling each other if the source is non moving, but non-zero outputs if the source is moving. Accordingly, the sensor ignores non-moving infrared radiation producing objects, such as heat radiators within the protected space, sunlight entering the protected space, etc., and detects only moving infrared radiation moving objects by outputting a signal corresponding to the velocity of movement of the objects.

Such detectors, however, are prone to false alarms. The problem of false alarms is particularly present where the protected space may include a moving household pet, which should he ignored by the detector system. However, existing detector systems have difficulty in distinguishing between a small household pet to be ignored by the system, and an intruder to actuate the alarm. This is particularly true when the household pet is close to the sensor, and the intruder is distant from the sensor.

Another source of false alarms is the presence of thermal disturbances within the monitored space, such as curtains which may flutter near a sensor, heaters or other machines generating heat, etc. Existing detector systems have difficulty in distinguishing between such thermal disturbances (to be ignored by the system) and an intruder (to actuate the system) and therefore may produce false alarms.

Frequent false alarms decrease the integrity of the detector system, and may even prompt the user to ignore the alarm or disconnect the system. On the other hand, reducing the sensitivity of the detector system to decrease false alarms reduces its sensitivity to detect intruders.

BRIEF SUMMARY OF THE INVENTION

According to one aspect of the present invention, there is a provided an intrusion detector for detecting an intrusion into a protected space overlying a predetermined surface, comprising: a housing to be mounted over the surface and including an infrared radiation sensor for sensing moving infrared radiation sources, and a transparent window thereover, a plurality of lens elements formed in the transparent window each oriented to receive infrared radiation from a moving infrared radiation source within a predetermined viewing zone of the protected space and to transmit infrared radiation from said source to the sensor; an alarm; and a control system for receiving the electrical output of the sensor and for outputting an alarm signal to the alarm when an infrared radiation source is detected simultaneously within at least two of the predetermined viewing zones.

According to further features in the described preferred embodiment the lens elements are oriented such that their viewing zones define a plurality of viewing planes at different inclinations with respect to the surface, with the viewing zones in the viewing planes of smallest inclinations detecting moving infrared radiation source most distant from the sensor. Each of the lens elements produces approximately the same magnitude of electrical output from the sensor irrespective of the distance of the infrared radiation source from the sensor.

More particularly, in the described preferred embodiment, the lens elements are designed such those having more distant viewing zones have larger optical gains in order to produce approximately the same magnitude of electrical output from the sensor irrespective of the distance of the moving infrared radiation source from the sensor. For this purpose, the lens elements are arranged according to a rectangular matrix of a plurality of horizontal rows, each defining one of the viewing planes, and a plurality of vertical columns, each defined by one of the lens elements in all the horizontal rows. The lens elements are of the same effective optical height in each horizontal row, but are of decreasing effective optical height from the uppermost horizontal row to the lowermost horizontal row, such that the lens elements in the uppermost horizontal row have the largest optical gain, and the lens elements in the lowermost horizontal row have the smallest optical gain.

According to another aspect of the present invention, there is provided an intrusion detector for detecting an intrusion into a protected space overlying a predetermined surface, comprising: a housing to be mounted over the surface and including an infrared radiation sensor for sensing moving infrared radiation sources, and a transparent window thereover; the transparent window being formed with a plurality of lens elements each oriented to receive infrared radiation from, a moving infrared radiation source within a predetermined viewing zone of the protected space and to transmit the radiation to the sensor to cause the sensor to produce an electrical output; an alarm; and a control system for receiving the electrical output of the sensor and for outputting an alarm signal to the alarm; the infrared radiation sensor having a low transfer function at high frequencies; the control system including an active filter circuit for amplifying the output signal from the sensor at a higher amplification gain for high frequencies than for low frequencies.

According to a further aspect of the present invention, there is provided an intrusion detector for detecting an intrusion into a protected space overlying a predetermined surface, comprising: a housing to be mounted over the surface and including an infrared radiation sensor for sensing moving infrared radiation sources, and a transparent window thereover; a plurality of lens elements formed in the transparent window each oriented to receive infrared radiation from a moving infrared radiation source within a predetermined viewing zone of the protected space and to transmit infrared radiation from the source to the sensor; an alarm; and a control system for receiving the electrical output of the sensor and for outputting an alarm signal to the alarm when a moving infrared radiation source is detected within a viewing zone; the control system generating a dynamic alarm threshold for the alarm signal, which alarm threshold dynamically varies according to the environmental noise conditions in the monitored space.

According to a still further aspect of the present invention, there is provided an intrusion detector for detecting an intrusion into a protected space overlying a predetermined surface, comprising: a housing to be mounted over the surface and including an infrared radiation sensor for sensing moving infrared sources, and a transparent window thereover; the transparent window being formed with a plurality of lens elements each oriented to receive infrared radiation from a moving infrared radiation source within a predetermined viewing zone of the protected space and to transmit the radiation to the sensor to cause the sensor to produce an electrical output therefrom; an alarm; and a control system for receiving the electrical output of the sensor and for outputting an alarm signal to the alarm; the infrared radiation sensor and control system being mounted on a printed circuit board within the housing, which printed circuit board is adjustable with respect to the transparent window by means or a slot formed in the printed circuit board movable with respect to a pin extending through the housing and the slot; the pin being rotatable to a first position to free the printed circuit board for adjustment along the slot, or to a second position to lock the printed circuit board in its adjusted position.

According to yet another aspect of the present invention, there is provided a method of detecting an intrusion into a protected space overlying a predetermined surface, comprising: mounting over the protected space an infrared radiation sensor capable of sensing moving infrared radiation sources; providing the sensor with a plurality of discrete viewing zones within the protected space; detecting a moving source of infrared radiation within any of the viewing zones; and producing an alarm signal when a moving source of infrared radiation is detected simultaneously in at least two of the viewing zones.

As will be described more particularly below, an intrusion detector may be constructed in accordance with some or all of the foregoing features to provide relatively high reliability in detecting intrusions and a relatively low rate of false alarms especially with respect to household pets and/or thermal disturbances within the monitored space.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
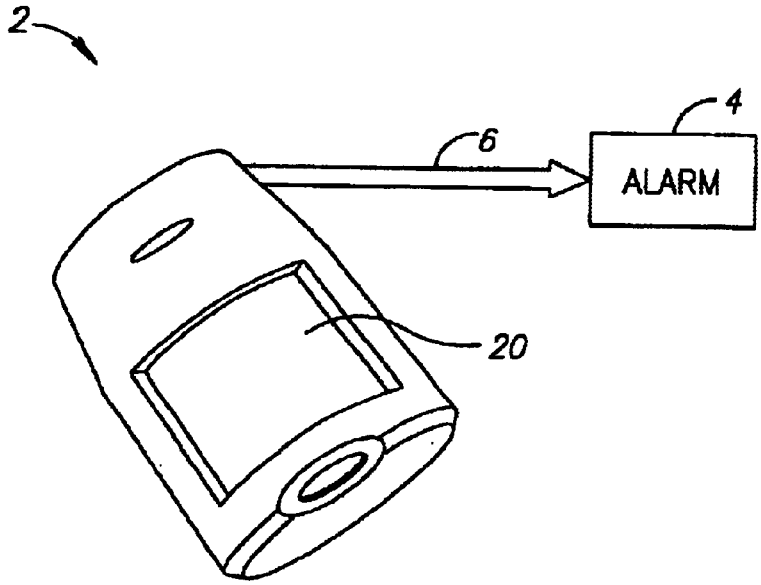
FIG. 1 illustrates one form of the intrusion detector constructed in accordance with the present invention.
Figure 3:
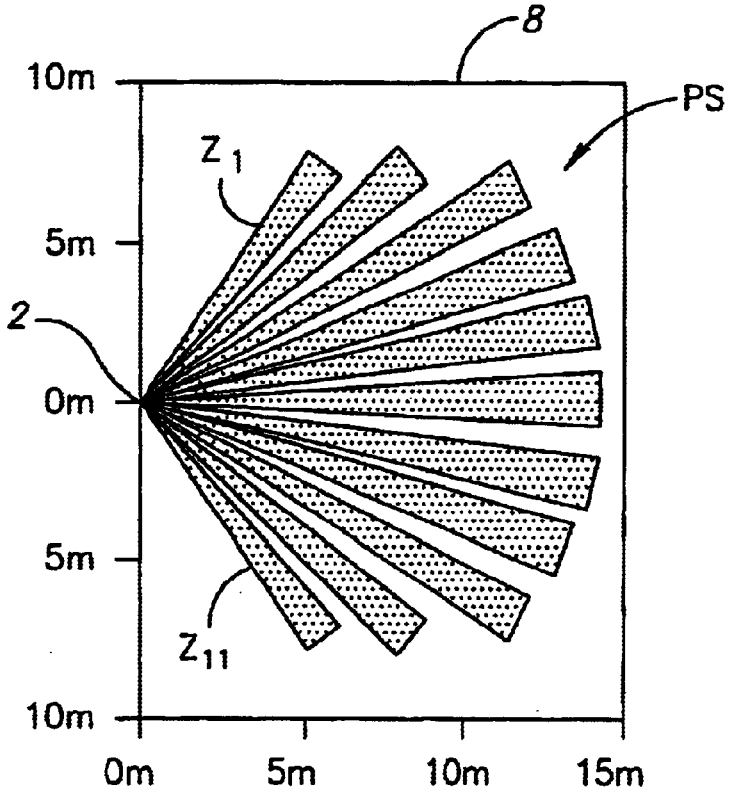
FIG. 3 is a top plan view schematically illustrating the plurality of vertical columns of receiving or detecting zones provided by the intrusion detector of FIGS. 1 and 2.
Figure 4:
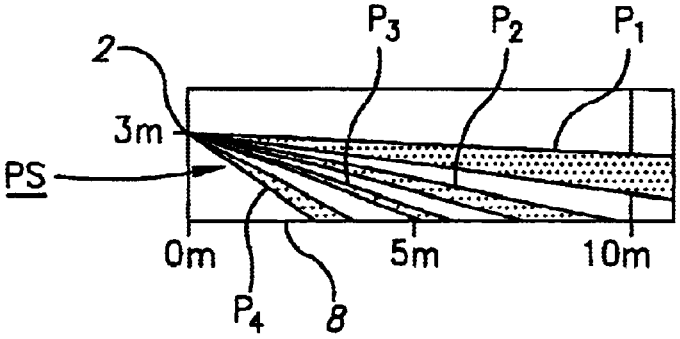
FIG. 4 is a side elevational view schematically illustrating the plurality of horizontal rows or planes of moving of detecting zones provided by the intrusion detector of FIGS. 1 and 2.

FIG. 1, illustrates an intrusion detector system including a detector unit, generally designated 2, for use in monitoring a protected space for intrusion, and an alarm unit, generally designated 4, connected in any suitable manner, as by cables 6 (or by wireless) to the detector unit 2 to be actuated by that unit when an intrusion is detected. The detector unit 2 is adapted to be mounted over the floor 8 (FIG. 3) of a room or other space PS to be protected in order to detect any intrusion into such a protected space PS. FIG. 3 is a top end view, and FIG. 4 is a side elevational view, schematically illustrating the detection zones viewed by the intrusion detector FIG. 2 when mounted over the floor 8 of a room to be protected against intrusion.

Figure 2:
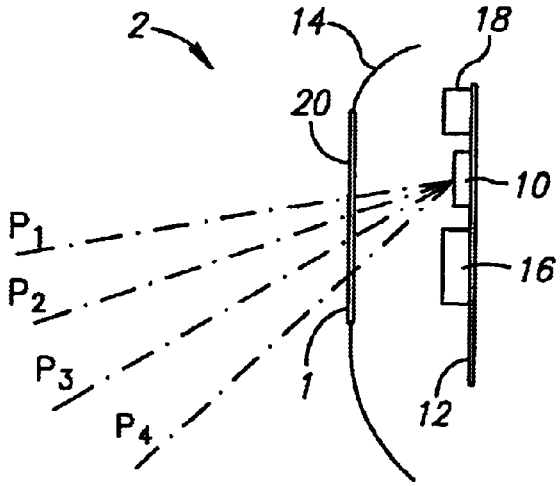
FIG. 2 schematically illustrates the construction of the intrusion detector of FIG. 1.

The main components of the intrusion detector unit 2 are schematically illustrated in FIG. 2. Thus, the intrusion detector 2 includes an infrared radiation censor 10 of the passive type mounted on a printed circuit board 12 within a housing 14. The printed circuit board 12 further carries the electrical circuitry, generally designated 16, for actuating the alarm unit 4 (FIG. 1) when an intrusion is detected. The control circuitry 16 is connected by outlet terminals 18, carried by the print circuit board 12, and cable 6 to the alarm unit 4.

The infrared radiation sensor 10 may be any known passive type capable of detecting moving infrared radiation sources, such as intruders, but ignoring non-moving sources, such as a heat radiator within the space being monitored, sun light entering the space being monitored, etc. As known in this art, such sensors include a pair, or quad, of closely-spaced sensor elements which are electrically connected in a bucking relationship to produce a substantially zero electrical output by a non-moving infrared radiation source, but a non-zero electrical output, corresponding to the movement velocity, by a moving radiation source.

Housing 14 further includes a transparent window 20 fur directing any infrared radiations originating within the room 8 to the sensor 10. Transparent window 20 is formed with a plurality of lens elements 21 (FIG. 5) each oriented to define a predetermined viewing or detection zone within room 8, and to transmit any infrared radiation detected within is respective viewing zone to the infrared sensor 10. The lens elements 21 of transparent window 20 are oriented such that their viewing zones define a plurality of viewing planes, designated $P_1$–$P_4$ in FIGS. 2 and 4, at different inclinations with respect to the floor 8 of the protected space PS. Thus, as shown in FIGS. 2 and 4, viewing plane $P_1$ of smallest inclination detects a moving infrared radiation source most distant from the sensor unit 2, whereas the viewing plane $P_4$ of largest inclination detects a moving infrared radiation source closest to the detector unit 2.

As shown in FIG. 3, the lens elements 21 within the transparent window 2 also divide each viewing plane $P_1$–$P_4$ into a plurality of viewing zones $Z_1$–$Z_{11}$ oriented at different azimuth angles with respect to the detector unit 2.

Figure 5:
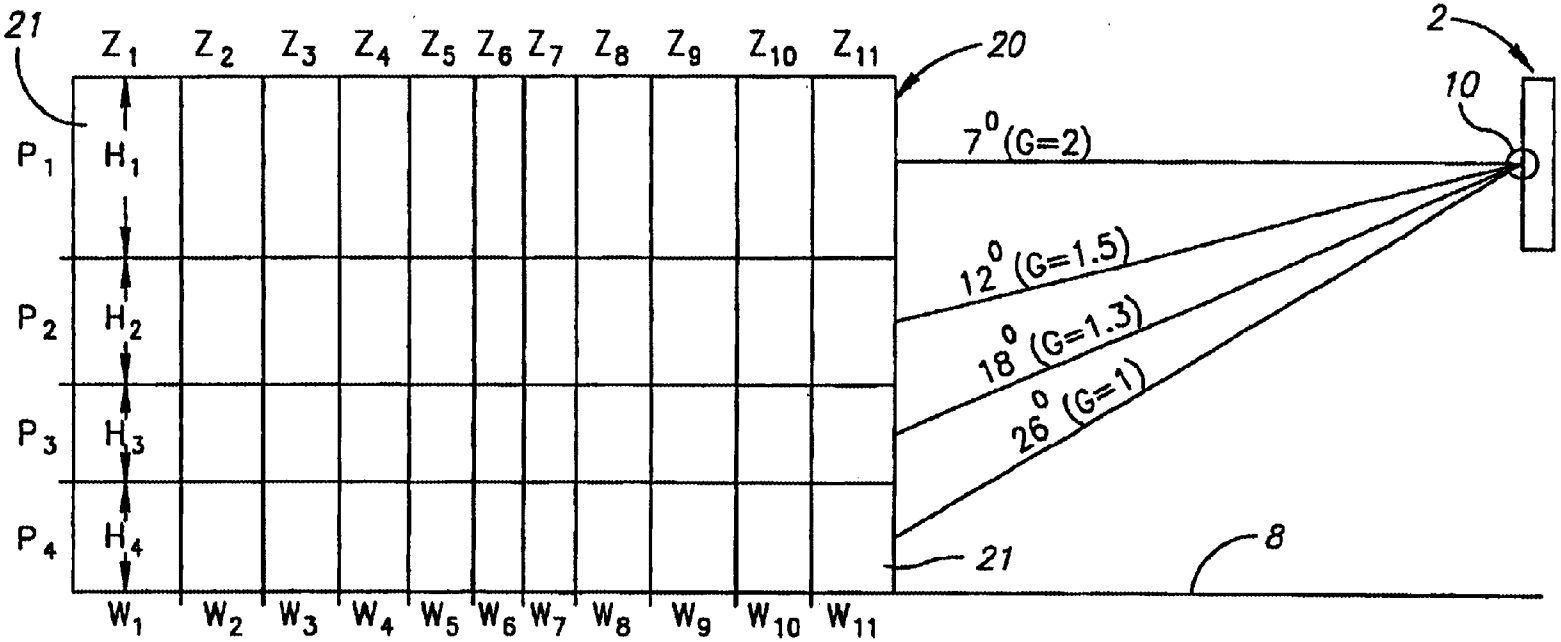
FIG. 5 schematically illustrator the plurality of lens elements in the transparent window of the intrusion detector of FIGS. 1–4.

FIG. 5 more particularly illustrates the construction of the transparent window 20. As shown, transparent window 20 is formed with a rectangular matrix of the lens elements 21 arranged in four horizontal rows and eleven vertical columns, each vertical column including one of the lens element 21 in the each of the foul horizontal rows. Thus, the four horizontal rows of lens elements define the four horizontal viewing planes $P_1$–$P_4$ at different inclinations, as illustrated in FIG. 4; whereas the eleven lens elements in each of the horizontal rows define the eleven vertical columns of viewing or detection zones $Z_1$–$Z_{11}$ at different azimuth angles with respect to the detector unit 2, as illustrated in FIG. 3.

The lens elements 21, of a Fresnel construction, are designed such that those lens elements defining more distant viewing zones have a larger optical gain than those defining closer viewing zones. The arrangement is such that each lens element produces approximately the same magnitude of electrical output from the infrared radiation sensor 10 irrespective of the distance of the infrared radiation source from the sensor. This is schematically indicated in FIG. 5, wherein it will be seen that the lens elements 21 in the upper row, defining the viewing plane $P_1$, have an optical gain of 2 (G=2); the lens elements in the next underlying row defining viewing plane $P_2$ have an optical gain of 1.5 (G=1.5); the lens elements defining the underlying viewing plane $P_3$ have an optical gain of 1.3 (G=1.3); and the lens elements defining the lowermost viewing plane $P_4$ have an optical gain of 1 (G=1).

These variations in the optical gain of the lens elements in the four viewing planes $P_1$–$P_4$ can be conveniently effected by controlling their effective optical heights (which take into account their angle with respect to the plane of the sensor, as distinguished from their physical height), i.e., by decreasing the effective optical height of the lens elements 21 from the uppermost horizontal row to the lowermost horizontal row. This can be seen from FIG. 5 wherein the effective optical heights $h_1$ of the lens elements in the uppermost plane $P_1$ are the largest, and decrease in the lower planes such that the effective optical heights $h_4$ of the lens elements in the lowermost piano $P_4$ are the smallest.

As also seen in FIG. 5, the widths of the lens elements 21 are the same in the four elements defining each vertical column, but differ among those defining the eleven vertical columns. Thus, with respect to the center vertical column of elements defining the middle zone 74, those lens elements are substantially parallel to the plane of the sensor 10, and therefore the four elements in the middle column $Z_6$ are of minimum width ($w_6$). The lens elements increase in angle with respect to the plane of sensor 10, and therefore increase in width, in both directions from the middle column such that the tour elements in the two end columns $Z_1$ and $Z_{11}$ are of maximum width ($w_1$, $w_{11}$) since they are at the maximum angle to the plans of the sensor 10.

FIG. 5 also illustrates the different inclination angles or the lens elements in the four viewing planes $P_1$–$P_4$. Thus, the lens elements 21 in the four viewing planes $P_1$, $P_2$, $P_3$ and $P_4$ are at inclination angles of 7°, 12° 18° and 26°, respectively, with respect to the floor 8 defining the protected space PS.

Because of the different optical gains provided by the lens elements 21 in the tour horizontal planes $P_1$–$P_4$, each lens element will produce approximately the same magnitude of electrical output from the sensor 10 irrespective of the distance of the moving infrared radiation source from the sensor. Thus, objects detected within the viewing zones of the lens elements 21 defining the uppermost viewing plane $P_1$ having the lowest inclination will be at the largest distance from the sensor 10, but their larger optical gain will more greatly amplify their output to the sensor 10 as compared to the closer objects detected by the detection zones defined by the lens elements 21 in the lowermost plane $P_4$ having the smallest optical gain. Also, these lens elements 21 in the middle vertical column $Z_6$, being substantially parallel to the plane of the sensor 10 and therefore defining a more favorable angle for transmitting the radiation to the sensor, have a smaller width than that of the lens elements at a less favorable angles with respect to the sensor, thereby also producing substantial uniform outputs from the sensors irrespective of the angle of the plane of the lens element with respect to the plane of the sensor.

The control system, schematically indicated at 16 in FIG. 2, for receiving the electrical output from the infrared radiation sensor 10, produces an alarm signal to actuate the alarm 4 only when a moving infrared radiation source is detected simultaneously within at least two of the viewing zones defined by the lens elements 21. These detection zones are dimensioned such that a small household pet will come within only one of the 44 detection zones defined by the four horizontal rows P1–P4 and eleven vertical columns $Z_1$–$Z_{11}$ of lens elements 21, and therefore will not actuate the alarm 4, whereas an actual intruder will tome within at least two of such viewing zones and will therefore actuate the alarm.

Thus, since the detection of a moving object within each of the detection zones will produce substantially the same magnitude of electrical output from the sensor 10, the described system will be sensitive only to the number of viewing zones simultaneously detecting a moving infrared radiation source, and not to the distance of that source from the sensor.

Figure 6:
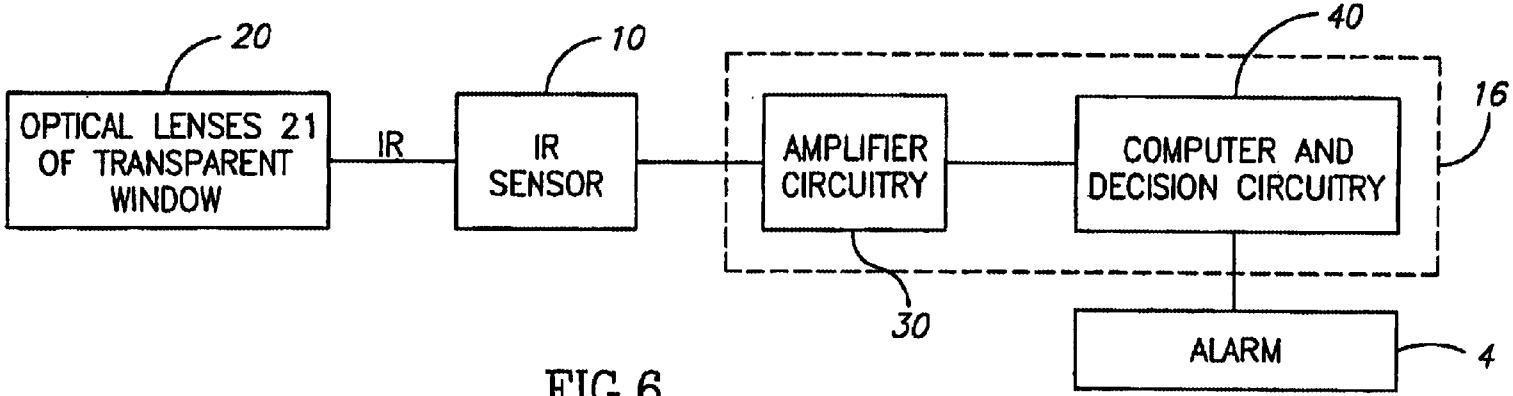
FIG. 6 is a block diagram illustrating the main components in the intrusion detector of FIG. 1.

The control circuit schematically indicated by box 16 in FIG. 2 is more particularly shown in block diagram form in FIG. 6. It includes amplifier circuitry 30 for amplifying the electrical output of the sensor 10, and a processor 40 for computing the magnitude of the electrical output and for determining whether the output of the sensor indicates the presence of an intruder, such as to produce an alarm signal to actuate the alarm 4. As described earlier, processor 40 produces ion alarm signal to actuate the alarm 4 only when a moving infrared radiation source is detected simultaneously within at least two of the viewing zones defined by the rectangular matrix of lens elements 21.

Figure 8:
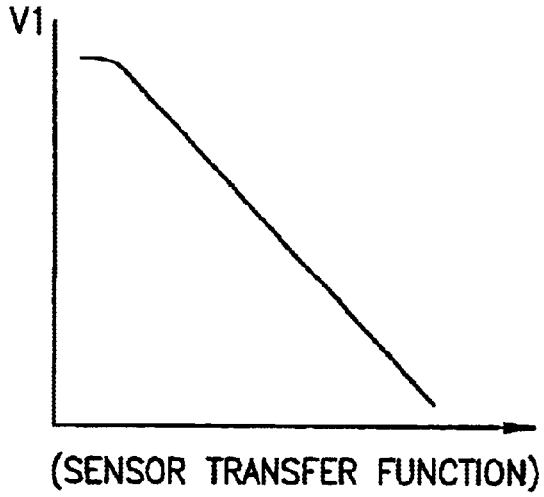
FIGS. 8 and 9*a*–9*c* are curves helpful in understanding how the active filter circuit illustrated in FIG. 7 compensates for the low transfer function of characteristics an infrared radiation sensor when included in an intrusion detector.

A characteristic of the infrared radiation sensors 10 now in commercial use is that they have a low transfer function at high frequencies. This characteristic is illustrated by the curve in FIG. 8, showing that the voltage level outputted by the sensor drops with the frequency. Accordingly, if such a sensor is used, an object moving swiftly within the protected space may produce such a low electrical output from the sensors 10 as not to be detected.

Figure 7:
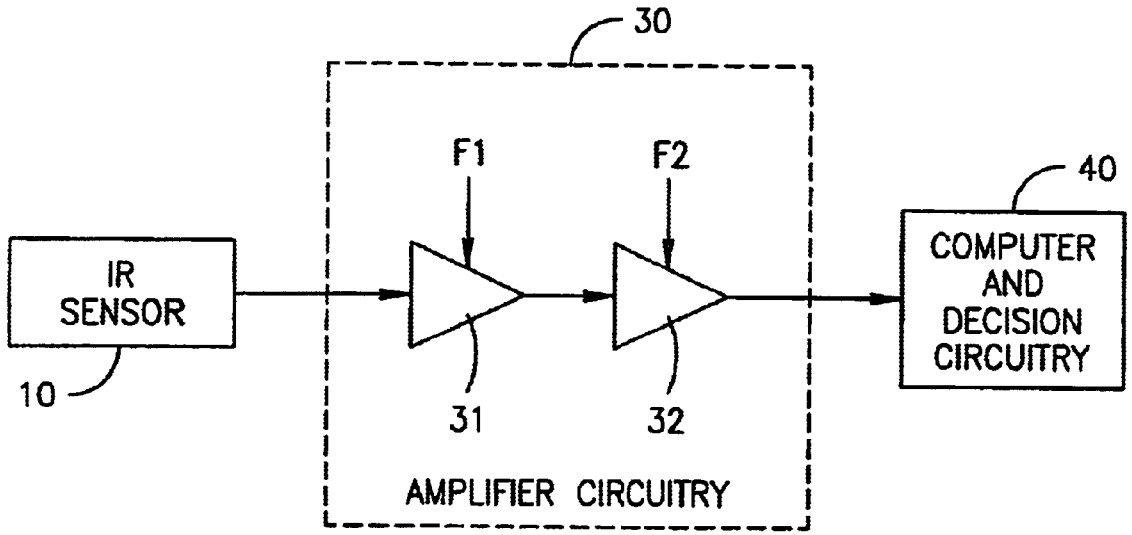
FIG. 7 is a block diagram illustrating a preferred analog circuit in the intrusion detector of FIG. 6 for compensating for the low transfer function characteristic of passive infrared radiation sensors.

FIG. 7 illustrates one form of an amplifier circuitry 30 which may be used to compensate for the low transfer function characteristic of infrared radiation sensors by adding extra gain for high frequency signals. Thus, as shown in FIG. 7, the amplifier circuitry 30 includes two active filters 31, 32 controlling the amplification of the signal received from the sensor 10.

Figure 9A:
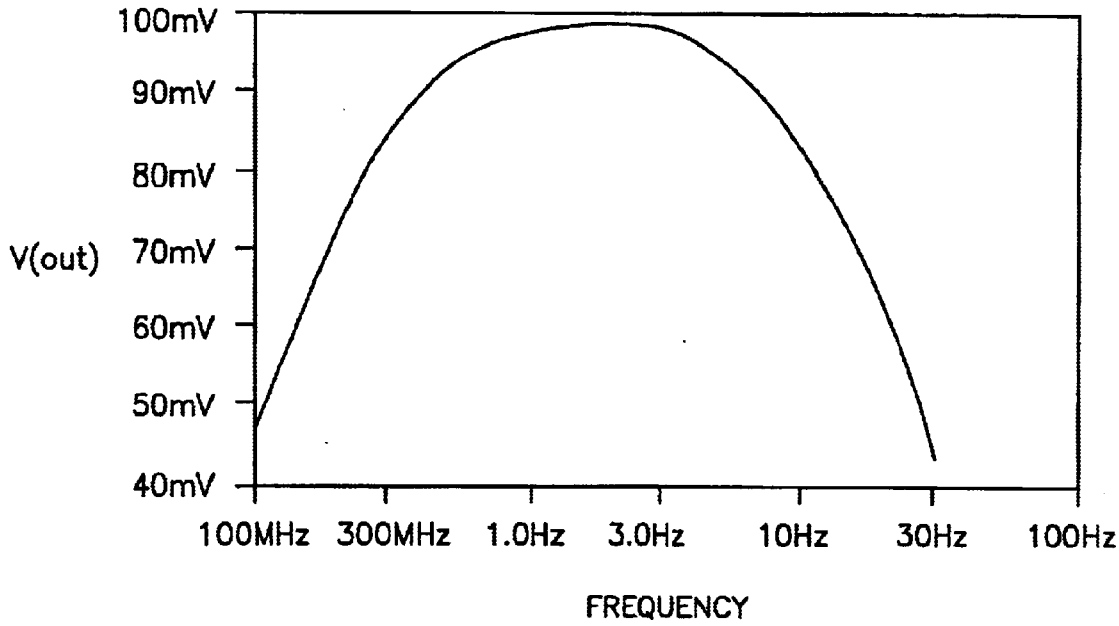
Figure 9B:
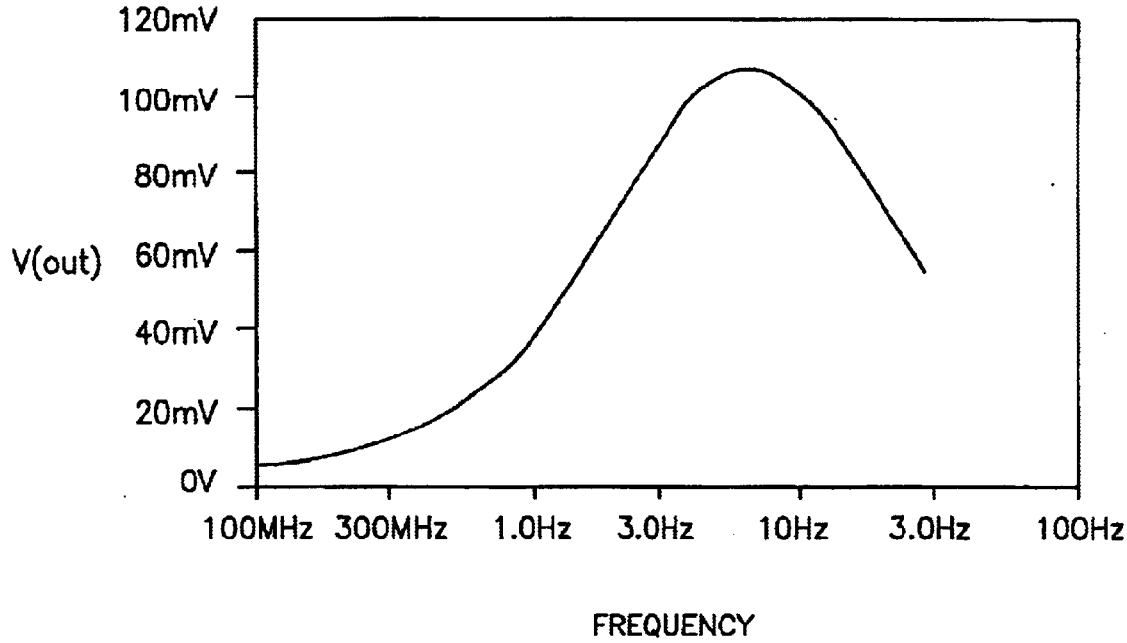
Figure 9C:
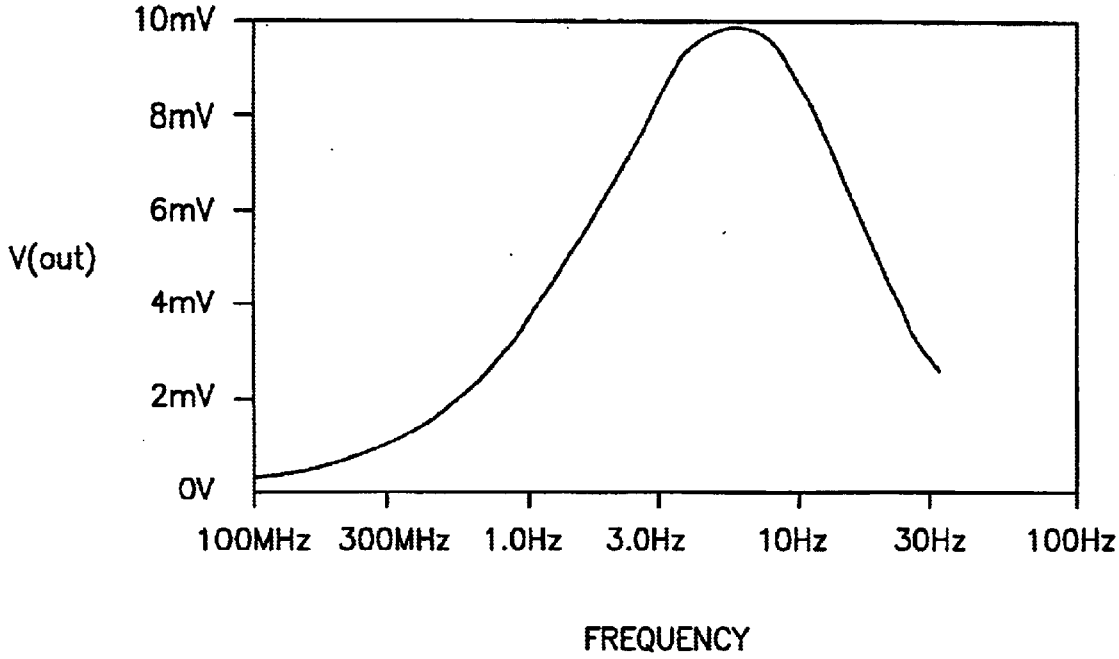

FIG. 9*a* illustrates the voltage frequency characteristic of tuned amplifier 31; FIG. 9*b* illustrates the voltage/frequency characteristic of tuned amplifier 32; and FIG. 9*c* illustrates the resultant voltage/frequency characteristic of the two tuned amplifiers 31, 32. It will be seen from FIG. 9*c* that the amplifier circuitry 30 including the two tuned amplifiers 31, 32 produces a larger amplification gain at higher frequencies than at lower frequencies, thereby compensating for the low transfer function characteristic of the sensor 10 at high frequencies.

Figure 10:
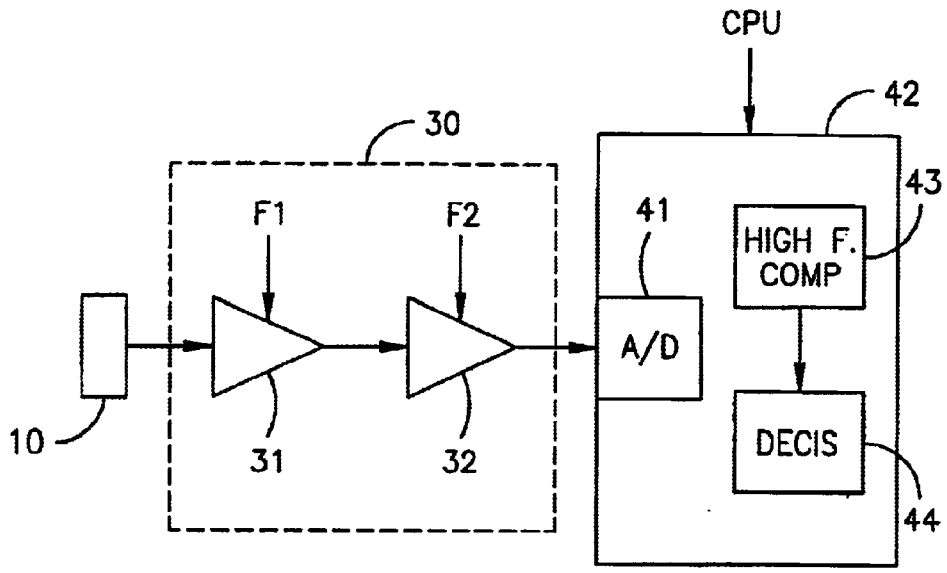
FIG. 10 is a block diagram illustrating a preferred digital circuit that may be used for compensating for the low transfer function characteristics of an infrared radiation sensor, rather than the analog circuit of FIG. 7.

While the frequency-compensation circuitry illustrated in FIG. 7 includes a processor 40 of the analog type, it will be appreciated that the same compensation can be effected by digital circuitry. FIG. 10 is a block diagram illustrating such a digital control system which may be used. Thus the output of the active filter circuit 30 as described above may be converted to digital form by an A/D converter 41 within a CPU 42 including programmed circuitry 43 to compensate the output of the sensor 10 at high frequencies as described above with respect to FIGS. 7–9C. The CPU 42 in the digital control system of FIG. 10 may also include the decision circuitry 44 described above for determining that an intrusion situation exists for actuating the alarm 4 when a moving infrared radiation source is detected simultaneously within at least two of the 44 predetermined viewing zones defined by the lens elements 21.

Figure 11:
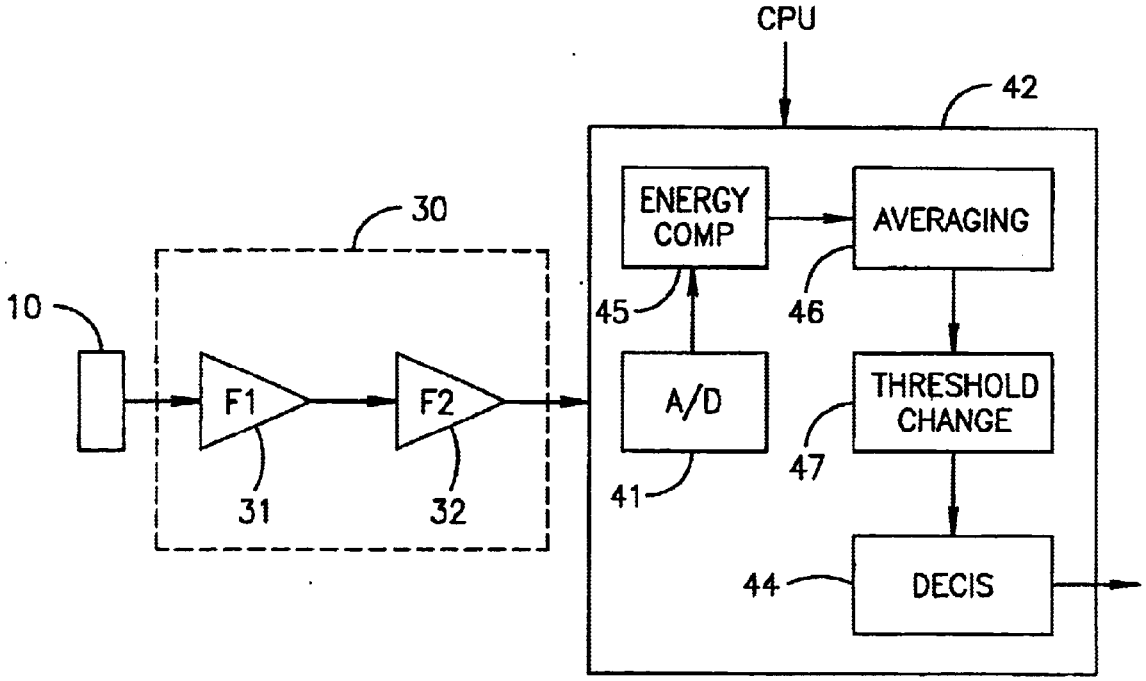
FIG. 11 the a block diagram illustrating another digital control system that may be used for reducing the possibility of false alarms by thermal disturbances within the monitored space.

FIG. 11 illustrates a control system similar to that of FIG. 10 but with CPU 42 programmed to perform additional tasks, as described below with respect to the flow chart of FIG. 12, in order to reduce the possibility of false alarms by thermal disturbances, such as heaters or other heat-generating machines within the monitored space, fluttering curtains affecting the external heat entering the monitored space, etc. For this purpose, the CPU 42 is programmed to generate a dynamic alarm threshold for the alarm signal, which alarm threshold dynamically varies according to the environmental noise conditions, e.g., sources of thermal disturbances such as those described above in the monitored space.

The control system illustrated in FIG. 11 may be the same as described above with respect to FIG. 10, except that the CPU 42 includes circuitry 45 for computing the energy (or power) of the signals outputted from the A/D converter 41, averaging circuitry 46 for averaging the output of circuitry 45, and threshold changing circuitry 47 for processing the output of the averaging circuitry 46 before being fed to the decision circuitry 44.

As will be described more particularly below with respect to the flow chart of FIG. 12, the CPU 42 periodically samples the output of the sensor 10. after filtering and amplifying in the active fitter circuit 30 and conversion to a digital form in converter 41, to produce a plurality of incoming pulses CPU 42 computes the energy of each pulse in circuitry 46, and produces an average of the energy of each pulse for a predetermined number of pulses in the averaging circuitry 46. This average is then utilized in circuitry 47 for changing the alarm threshold to be used by the decision circuitry of 44 according to the environmental noise conditions in the monitored space. Thus, the alarm threshold is changed only when needed because of the environmental conditions, and only to the extent needed in order to avoid false alarms.

One way of averaging would be to accumulate the values of each pulse over a predetermined time period, e.g., one minute, and divide the total value by the number of pulses. The disadvantage or such a method is that there would be a delay between each updating (e.g., one minute in the example described).

Figure 12:
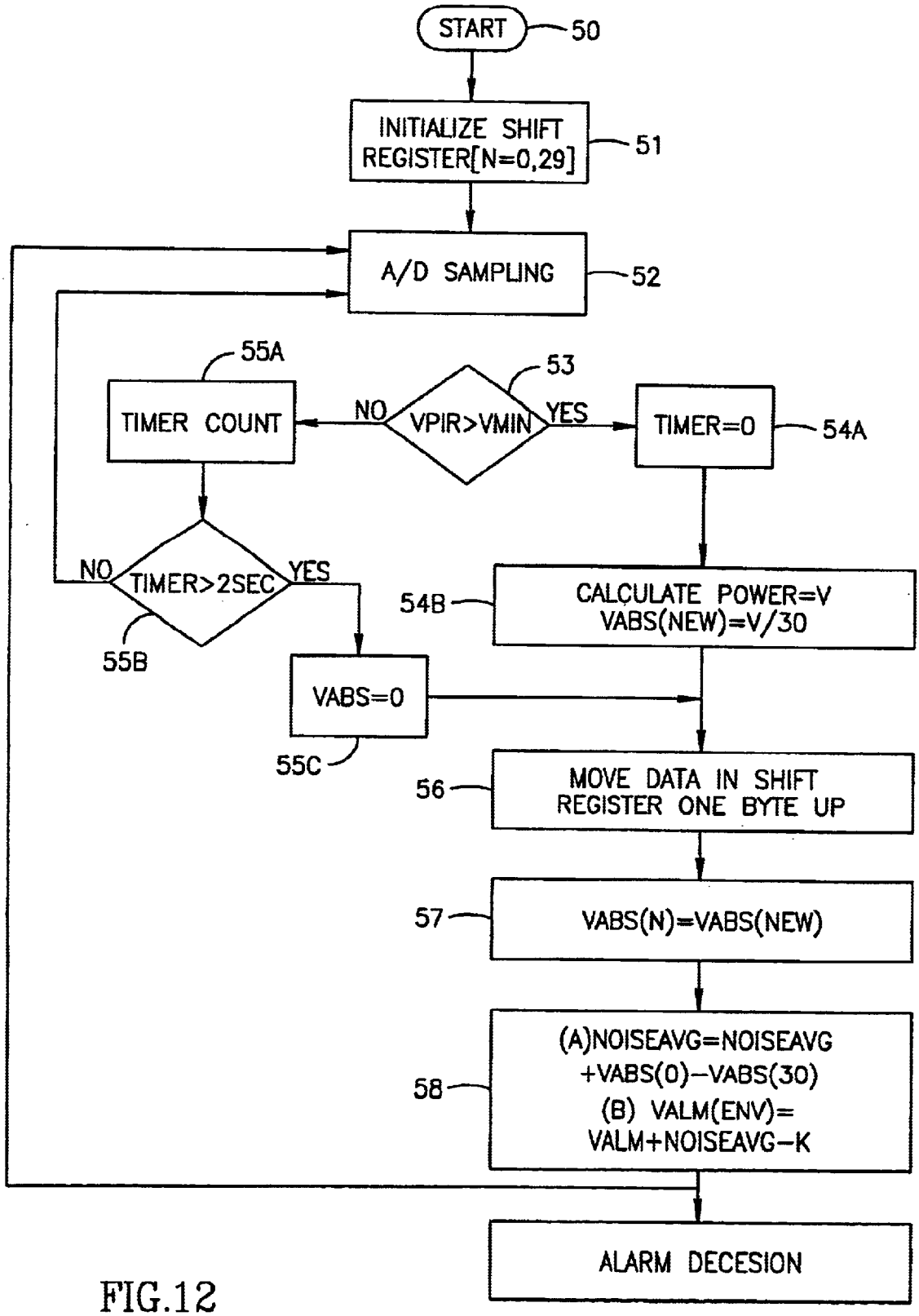
FIG. 12 is a flow chart more particularly illustrating the operation of the control system of FIG. 11.

Another manner of averaging would be to divide the value of each pulse by the total number of pulses, and then add them over a predetermined time period; but this method would also involve a delay in updating the dynamic threshold.

in the preferred embodiment illustrated by the flow chart of FIG. 12, the averaging circuitry 46 produces an average of the sensor outputs received from the energy computer circuitry 45 in a dynamic manner for a predetermined number of pulses by: (a) inputting the value of each pulse into a shift register having a plurality of storage locations and operating in a FIFO manner to shift the pulse values from the first storage location and out of the last storage location; and (b) with each inputted pulse adding, to each previously produced average, the value of the pulse inputted into the first storage location minus the value of the pulse outputted from the last storage location, in this manner, a dynamic alarm threshold is generated for the alarm signal with each inputted pulse based on the average energy (or power) of the preceding 30 pulses. It will be seen that, even though the averaging is over 30 pulses, the dynamic alarm threshold is updated with each new pulse, thereby providing a continuously-generated dynamic threshold.

Since the latter described method is dependent on the number of pulse received, rather than on time, there may be a dead period when no pulses are received (i.e., no thermal disturbances), which would thereby greatly distort the average. To avoid this, the threshold changing circuitry 47 in FIG. 11 inputs a "0" when the value of the pulse is less than a predetermined noise threshold for a predetermined time period. In the example described below with respect to the flow chart of FIG. 12, this time period is two seconds, the number of pulses is 30, and the sampling frequency is 600 Hz.

According to further features in the system described below with respect to the flow chart of FIG. 12, the control system generates the dynamic alarm threshold by adding, to an initial alarm threshold, an environmental noise factor corresponding to the average of the sensor outputs produced for the predetermined number of pulses. The control system, in generating the dynamic alarm threshold, also subtracts from the initial alarm threshold a correction factor constituting a predetermined percentage of the initial (factory) noise alarm threshold, so as to be insensitive to short or small transient thermal interferences.

The flow chart of FIG. 12 illustrates a preferred mode of operation of the system of FIG. 11 in order to dynamically generate an alarm threshold for the alarm signal according to the environmental noise conditions in the monitored space.

Thus, at the Start (block 50), the control system initializes the shift register (block 51) by allocating, e.g., 30 bytes of memory for the shift register. The system then samples the output of sensor 10, at a sampling frequency of e.g., 600 Hz (block 52) after amplification and filtration by the tuned circuitry 30, and after conversion to digital form by A/D converter 41. The maximum voltage of each pulse is then compared with an initial (e.g., factory-set) noise threshold (block 53). If it is found to exceed that threshold, a timer is restarted (block 54*a*). The energy (or power) of the respective pulse is calculated, and then divided by 30, to produce the average energy for the pulse (block 64*b*). This value is inputted into the first storage location of the shift register (blocks 56, 57).

On the other hand, if the inputted signal is below the noise threshold (as determined by block 53) a counter is activated (block 55*a*); and if this condition persists for two seconds (block 56*b*), an average noise value of "0" (block 55*c*) is inputted into the first storage location of the shift register (blocks 56, 67).

It will thus be seen that with each inputted sample, the value of the sample is shifted one position from the first storage location within the shift register to and out through the last (30th) storage location.

Block 58 is coupled to the shift register to perform two operations indicated at (a) and (b) with respect to the contents thereof.

As indicated by operation (a), with each inputted sample, the processor adds, to each previously produced average [Noiseavg] the value of the sample inputted into the first storage location [Vabs(0)], minus the value of the sample outputted from the last storage location [Vabs (30)]. Then, as indicated by operation (b) of block 58, the processor continuously updates the noise alarm threshold, to generate a dynamic noise alarm threshold [Valm(env)], by taking the initial (factory) noise alarm threshold [Valm], adding the current noise average power factor [Noiseavg] as determined in operation (a), and subtracting a correction factor (K) corresponding to a percentage of the initial (factory) noise alarm threshold, to ignore short, transient thermal disturbances; as one example, "K" could be 10%. In any case the updated (dynamic) noise alarm threshold [Valm (env)] is not allowed to be less than the initial (factory) noise alarm threshold.

The dynamic alarm threshold, as dynamically generated by the processor in accordance with block 58, is outputted to the decision circuit 44 (FIG, 11), for controlling the alarm so as to increase the alarm threshold in a dynamic manner only when, and to the extent necessitated by the current environmental conditions, thereby providing maximum sensitivity for detecting intrusions while avoiding false alarms.

Figure 13:
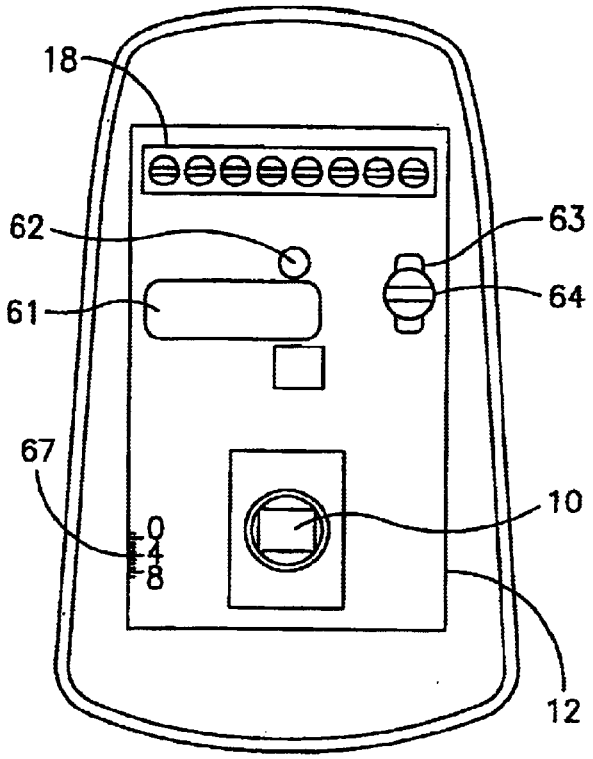
FIG. 13 illustrates the intrusion detector of FIG. 1 but with the outer cover removed to show internal structure and particularly to show the adjustable mounting of the printed circuit board within its housing.

FIG. 13 illustrates the intrusion detector 2 of FIGS. 1 and 2 with the cover containing the transparent window 20 removed in order to show the internal structure. Thus, as seen in FIG. 13, the infrared radiation sensor 10 is mounted on printed circuit board 12. The printed circuit board also mounts the terminal block 18 carrying the output terminals to the alarm unit 4 (FIG. 1), a relay 61 controlled by the output of the decision circuitry 44 (FIGS. 10 or 11) to actuate the alarm unit 4, and an LED 62 for indicating an alarm condition.

Figure 14:
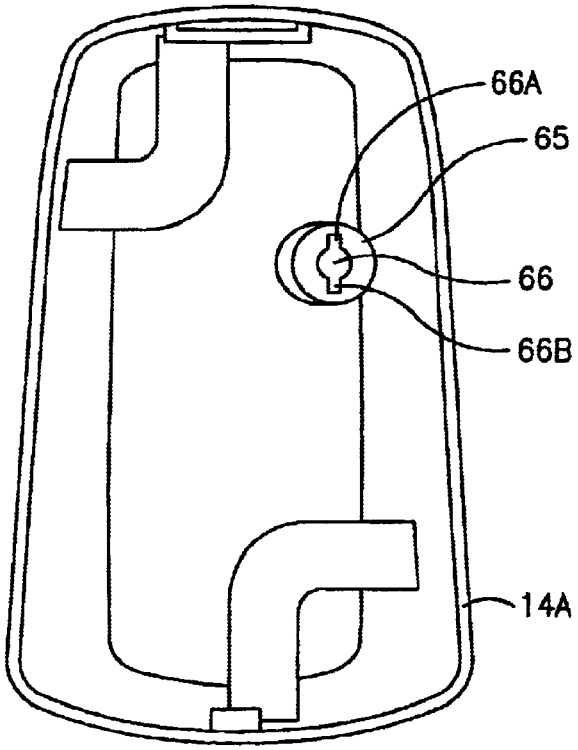
FIG. 14 illustrates the back housing section and particularly its construction for locking the printed circuit board in its adjusted position within its housing.

The infrared radiation sensor 10 is adjustably mounted within housing 14 so as to permit fine adjustment of the sensor with respect to the transparent window 20, particularly with respect to its rectangular matrix of lens elements 21. For this purpose, the printed circuit board 12 is formed with a vertical slot 63 adapted to receive a pin 64 rotatably mounted within a socket 65 in the back section 14*a* (FIG. 14) of housing 14, either to a releasing position, or to a locking position with respect to the printed circuit board 12.

Figure 15:
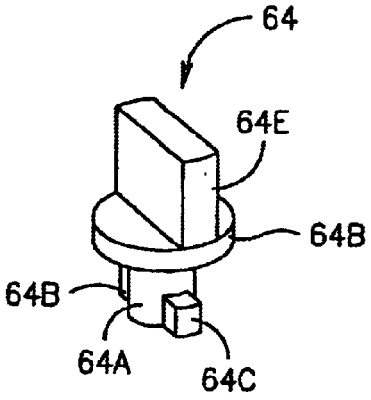
FIG. 15 is a three-dimensional view of the pin for locking the circuit board in it adjusted position.

Socket 66 is closed by an end wall formed with a key-hole 66 for receiving the shank 64*a* of pin 64 (FIG. 15), and with a pair of diametrically-opposed slots 66*a*, 66*b*, for receiving a pair of teeth 64*b*, 64*c* of pin 64. Pin 84 is further formed with a limit disc 64*d* between its finger-gripping end 64*e* and its shank 64*a*.

Pin 64 may thus be inserted through key-hole 66 of the socket 65, with its teeth 64*b*, 64*c* aligned with slot 66*a*, 66*b*. Pin 64 is dimensioned such that when its teeth are aligned with the slots and its limit disc 64*d* engages the end wall of socket 65, the tip of the pin shank 64*a* is in a released position sightly spaced from the printed circuit board 12; but when the pin 64 is rotated 90°, its two teeth 64*b*, 64*c* engage the undersurface of socket 65 to force shank 64*a* firmly against the printed circuit board and thereby to lock the printed circuit board in position.

In order to precisely adjust sensor 10, pin 64 is first rotated to its releasing position, whereupon the printed circuit board 12 may be moved vertically within slot 63 to precisely position the sensor 10 with respect to the matrix of lens element 21 in the transparent window 20. When the printed circuit board is precisely positioned, pin 64 may then be manually rotated to its locking position to force it against the printed circuit board and thus to lock the board in its adjusted position.

The printed circuit board 12 preferably includes a vertical scale 67 along one edge relative to a reference line (not shown) on housing section 14*a* to facilitate the vertical adjustment of the printed circuit board.

While the invention has been described with respect to one preferred embodiment, it will be appreciated that this is set forth merely for purposes of example, and that many variations may be made. For example, an electronic gain-control system, rather then an optical gain-control system, could be used for producing approximately the same magnitude of electrical output from the sensor irrespective of the distance of the moving infrared radiation source from the sensor. Further the feature of controlling gain in response to frequency, and/or the feature of providing a dynamically varying alarm threshold, could be used in other detector systems. Also, while the window 20 is curved symmetrically with respect to its longitudinal axis, it could be curved also symmetrically with respect to its transverse axis.

It will also be appreciated by persons skilled in the art that the present invention is not limited by what has be on particularly shown and described herein above. Many other variations, modifications and applications of the invention will be apparent. Rather the scope of the present invention is defined only by the claims which follow.

What is claimed is:

1. An intrusion detector for detecting an intrusion into a protected space overlying a predetermined surface, comprising:

a housing to be mounted over said surface and including an infrared radiation sensor for sensing moving infrared radiation sources, and a transparent window thereover;

a plurality of lens elements formed in said transparent window each oriented to receive infrared radiation from a moving infrared radiation source within a predetermined viewing zone of said protected space and to transmit infrared radiation from said source to said sensor;

an alarm; and a control system for receiving the electrical output of said sensor and for outputting an alarm signal to said alarm when a moving infrared radiation source is simultaneously detected within at least two of said predetermined viewing zones, wherein said lens elements are oriented such that their viewing zones define a plurality of viewing planes at different inclinations with respect to said surface, with the viewing zones in the viewing planes of smallest inclinations detecting moving infrared radiation sources most distant from the sensor, and wherein each of the lens elements produces approximately the same magnitude of electrical output from said sensor irrespective of the distance of the moving infrared radiation source from the sensor.

2. The detector according to claim 1, wherein said lens elements are designed such that the lens elements having more distant viewing zones have larger optical gains in order to produce approximately the same magnitude of electrical output from the sensor irrespective of the distance of the moving infrared radiation source from the sensor.

3. The detector according to claim 1, wherein said lens elements are arranged according to a rectangular matrix of a plurality of horizontal rows, each defining one of said viewing planes, and a plurality of vertical columns, each defined by one of said lens elements in all said horizontal rows.

4. The detector according to claim 3, wherein the lens elements are of the same effective optical height in each horizontal row, but are of decreasing effective optical height from the uppermost horizontal row to the lowermost horizontal row, such that the lens elements in the uppermost horizontal row have the largest optical gain, and the lens elements in the lowermost horizontal row have the smallest optical gain.

5. The detector according to claim 4, wherein said lens are of equal width in said horizontal rows and of varying widths in said vertical columns.

6. The detector according to claim 3, wherein said lens elements define a rectangular matrix of four horizontal rows and eleven vertical columns.

7. The detector according to claim 1, wherein said infrared radiation sensor has a low transfer function at high frequencies, said control system including an active filter circuit for amplifying the output signal from the sensor at a higher amplification gain for high frequencies than for low frequencies.

8. The detector according to claim 1, wherein said control system generates a dynamic alarm threshold for said alarm signal, which alarm threshold dynamically varies according to the environmental noise conditions in the monitored space.

9. The detector according to claim 8, wherein said control system periodically samples the output of said sensor to produce a plurality of incoming pulses, produces an average of said sensor outputs for a predetermined number of incoming pulses, and utilizes cold average of the sensor outputs for generating said dynamic alarm threshold.

10. The detector according to claim 1, wherein said control system generates said dynamic alarm threshold by adding, to an initial alarm threshold, an environmental noise factor corresponding to the average of said sensor outputs dynamically produced for said predetermined number of samples.

11. The detector according to claim 1, wherein said infrared radiation sensor and control system are mounted on a printed circuit board within said housing, which printed circuit board is adjustable with respect to said transparent window.

12. The detector according to claim 1, wherein said printed circuit board is adjustable with respect to said transparent window by means of a slot formed in the printed circuit board movable with respect to a pin extending through said housing and said slot; said pin being rotatable to a first position to free the printed circuit board for adjustment along said slot, or to a second position to lock the printed circuit board in its adjusted position.

13. An intrusion detector for detecting an intrusion into a protected space overlying a predetermined surface, comprising:

a housing to be mounted over said surface and including an infrared radiation sensor for sensing moving infrared radiation sources, and a transparent window thereover;

a plurality of lens elements formed in said transparent window each oriented to receive infrared radiation from a moving infrared radiation source within a predetermined viewing zone of said protected space and to transmit infrared radiation from said source to said sensor;

an alarm; and a control system for receiving the electrical output of said sensor and for outputting an alarm signal to said alarm when a moving infrared radiation source is simultaneously detected within at least two of said predetermined viewing zones;

wherein said control system generates a dynamic alarm threshold for said alarm signal, which alarm threshold dynamically varies according to the environmental noise conditions in the monitored space, wherein said control system periodically samples the output of said sensor to produce a plurality of incoming pulses, produces an average of said sensor outputs for a predetermined number of incoming pulses, and utilizes said average of the sensor outputs for generating said dynamic alarm threshold; and wherein said control system produces an average of said sensor outputs in a dynamic manner for a predetermined number of pulses, by:

inputting the value of each pulse into a shift register having a plurality of storage locations and operating in a FIFO manner to shift said pulse values from the first storage location to and out of the last storage location; and with each inputted pulse, adding, to each previously produced average, the value of the pulse inputted into the first storage location minus the value of the pulse outputted from the last storage location.

14. The detector according to claim 13, wherein each pulse value inputted into the shift register is the energy of the respective pulse divided by the number of storage locations in the shift register.

15. The detector according to claim 14, wherein said control system inputs a "0" value for a pulse when the value of the pulse is less than a predetermined noise threshold for a predetermined time period.

16. The detector according to claim 15, wherein there are 30 storage locations in the shift register, and said predetermined time period is about 2 seconds.

17. The detector according to claim 15, wherein said control system is an analog system.

18. The detector according to claim 15, wherein said control system is digital system.

19. The detector according to claim 15, wherein:

each of said lens elements produces approximately the same magnitude of electrical output from said sensor irrespective of the distance of the moving infrared radiation source from the sensor; and said control system outputs said alarm signal when a moving infrared radiation source is simultaneously detected within at least two of said predetermined viewing zones.

20. An intrusion detector for detecting an intrusion into a protected space overlying a predetermined surface, comprising:

a housing to be mounted over said surface and including an infrared radiation sensor for sensing moving infrared radiation sources and a transparent window thereover;

a plurality of lens elements formed in said transparent window each oriented to receive infrared radiation from a moving infrared radiation source within a predetermined viewing zone of said protected space and to transmit infrared radiation from said source to said sensor;

an alarm; and a control system for receiving the electrical output of said sensor and for outputting an alarm signal to said alarm when a moving infrared radiation source is detected within a viewing zone;

said control system generating a dynamic alarm threshold for said alarm signal, which alarm threshold dynamically varies according to the environmental noise conditions in the monitored space;

wherein said control system periodically samples the output of said sensor to produce a plurality of incoming pulses, produces an average of said sensor outputs for a predetermined number of incoming pulses, and utilizes said average of the sensor outputs for generating said dynamic alarm threshold; and wherein said control system produces an average of said sensor outputs in a dynamic manner for a predetermined number of pulses, by:

inputting the value of each pulse into a shift register having a plurality of storage locations and operating in a FIFO manner to shift said pulse values from the first storage location to and out of the last storage location; and with each inputted pulse, adding, to each previously produced average, the value of the pulse inputted into the first storage location minus the value of the pulse outputted from the last storage location.

21. The detector according to claim 20, wherein each pulse value inputted into the shift register is the energy of the respective pulse divided by the number of storage locations in the shift register.

22. The detector according to claim 21, wherein said control system inputs a "0" value for a pulse when the value of the pulse is less than a predetermined noise threshold for a predetermined time period.

23. The detector according to claim 22, wherein there are 30 storage locations in the shift register, and said predetermined time period is about 2 seconds.

24. The detector according to claim 23, wherein said control system, in generating said dynamic alarm threshold, also subtracts from said dynamic alarm threshold a correction factor constituting a predetermined percentage of the initial noise alarm threshold, but does not allow the dynamic alarm threshold to drop below this initial noise alarm threshold.

25. An intrusion detector for detecting an intrusion into a protected space overlying a predetermined surface, comprising:

a housing to be mounted over said surface and including an infrared radiation sensor for sensing moving infrared radiation sources and a transparent window thereover;

a plurality of lens elements formed in said transparent window each oriented to receive infrared radiation from a moving infrared radiation source within a predetermined viewing zone of said protected space and to transmit infrared radiation from said source to said sensor;

an alarm; and a control system for receiving the electrical output of said sensor and for outputting an alarm signal to said alarm when a moving infrared radiation source is detected within a viewing zone;

said control system generating a dynamic alarm threshold for said alarm signal, which alarm threshold dynamically varies according to the infrared noise level in the monitored space;

wherein said control system periodically samples the output of said sensor to produce a plurality of incoming pulses, produces an average of said sensor outputs for a predetermined number of incoming pulses, and utilizes said average of the sensor outputs for generating said dynamic alarm threshold; and wherein said control system generates said dynamic alarm threshold by adding, to an initial alarm threshold, an environmental noise factor corresponding to the average of said sensor outputs dynamically produced for said predetermined number of samples.

26. An intrusion detector for detecting an intrusion into a protected space overlying a predetermined surface, comprising:

a housing to be mounted over said surface and including an infrared radiation sensor for sensing moving infrared radiation sources, and a transparent window thereover;

said transparent window being formed with a plurality of lens elements each oriented to receive infrared radiation from a moving infrared radiation source within a predetermined viewing zone of said protected space and to transmit said radiation to said sensor to cause said sensor to produce an electrical output therefrom:

an alarm; and a control system for receiving the electrical output of said sensor and for outputting an alarm signal to said alarm;

said infrared radiation sensor and control system being mounted on a printed circuit board within said housing, which printed circuit board is adjustable with respect to said transparent window by means of a slot formed in the printed circuit board movable with respect to a pin extending through said housing and said slot;

said pin being rotatable to a first position to free the printed circuit board for adjustment along said slot, or to a second position to lock the printed circuit board in its adjusted position.

27. The detector according to claim 26, wherein:

each of said lens elements produces approximately the same electrical output from said sensor irrespective of the distance of the moving infrared radiation source from the sensor; and said control system outputs an alarm signal when a moving infrared radiation source is simultaneously detected within at least two of said predetermined viewing zones.

28. The method according to claim 27, wherein said alarm signal is produced according to an alarm threshold which dynamically varies according to the environmental noise conditions in the monitored space.

29. An intrusion detector for detecting an intrusion into a protected space overlying a predetermined surface, comprising:

a housing to be mounted over said surface and including an infrared radiation sensor for sensing moving infrared radiation sources, and a transparent window thereover;

a plurality of lens elements formed in said transparent window each oriented to receive infrared radiation from a moving infrared radiation source within a predetermined viewing zone of said protected space and to transmit infrared radiation from said source to said sensor;

an alarm; and a control system for receiving the electrical output of said sensor and for outputting an alarm signal to said alarm when a moving infrared radiation source is simultaneously detected within at least two of said predetermined viewing zones;

wherein said control system generates a dynamic alarm threshold for said alarm signal, which alarm threshold dynamically varies according to the environmental noise conditions in the monitored space, wherein said control system periodically measures the output of said sensor to produce a plurality of incoming measured signals, produces an average of said sensor outputs for a predetermined number of incoming measured signals, and utilizes said average of the sensor outputs for generating said dynamic alarm threshold; and wherein said control system produces an average of said sensor outputs in a dynamic manner for a predetermined number of measured signals, by:

inputting the value of each measured signal into a delay unit having a plurality of storage locations and operating in a FIFO manner to shift said measured signals from the first storage location to and out of the last storage location; and with each inputted measured signal, adding, to each previously produced average, the value of the measured signal inputted into the first storage location minus the value of the measured signal outputted from the last storage location.

* * * * *

UNITED STATES PATENT AND TRADEMARK OFFICE

CERTIFICATE OF CORRECTION

PATENT NO. : 6,642,846 B1
DATED : November 4, 2003
INVENTOR(S) : Krubiner, Dani et al.

It is certified that error appears in the above-identified patent and that said Letters Patent is hereby corrected as shown below:

Title page,
Insert item:
-- [30] Foreign Application Priority Data
December 6, 1998 (IL) 127407 --

Signed and Sealed this

Sixth Day of April, 2004

JON W. DUDAS
*Acting Director of the United States Patent and Trademark Office*